United States Patent [19]

Binstock et al.

[11] 4,135,854

[45] Jan. 23, 1979

[54] CONTROL SYSTEM FOR VARIABLE PITCH AXIAL FAN FOR UTILITY BOILER

[75] Inventors: Morton H. Binstock, Pittsburgh, Pa.; Bertram H. Stern, Poughkeepsie, N.Y.

[73] Assignee: Westinghouse Electric Corp., Pittsburgh, Pa.

[21] Appl. No.: 751,404

[22] Filed: Dec. 16, 1976

[51] Int. Cl.[2] ..... F04D 27/00

[52] U.S. Cl. ..... 416/37; 416/42; 415/48

[58] Field of Search ..... 416/245 C, 42, 157 C, 416/40, 31, 37; 415/17, 47, 48, 49, 118

[56] References Cited

U.S. PATENT DOCUMENTS

| | | | |
|---|---|---|---|
| Re. 28,946 | 8/1976 | Martz et al. | 415/17 |
| 2,407,925 | 9/1946 | Gilfillan | 415/49 X |
| 2,477,954 | 8/1949 | Blanc | 416/157 C X |
| 2,661,145 | 12/1953 | Heineman | 415/49 X |
| 2,938,536 | 5/1960 | Ehrenberg | 415/49 |
| 3,292,845 | 12/1966 | Hens et al. | 415/17 X |
| 3,744,925 | 7/1973 | Kraemer | 415/17 |

FOREIGN PATENT DOCUMENTS

| | | | |
|---|---|---|---|
| 1019046 | 11/1957 | Fed. Rep. of Germany | 416/157 C |
| 2155311 | 5/1973 | Fed. Rep. of Germany | 415/118 |
| 674657 | 6/1952 | United Kingdom | 416/157 C |

*Primary Examiner*—Everette A. Powell, Jr.
*Attorney, Agent, or Firm*—E. C. Arenz

[57] ABSTRACT

The disclosed system detects the pressure rise across the fan and the flow rate in the system and integrates signals corresponding thereto, and outputs a signal to indicate to the user when the pressure rise exceeds a given level for a corresponding flow rate to warn of a condition within a given degree of a stall condition. The system outputs another signal to block any increase in fan blade pitch and substitutes a decrease pitch signal in response to a predetermined closer approach to a stall condition so that the pitch of the blades is reduced to a position in which the pressure rate rise and flow rate are reduced to a safe level with respect to a stall condition. The system also includes means responsive to the predetermined closer approach to stall to prevent the user from feeding a blade pitch increase signal following a reduction in the pressure rise across the fan until the user resets a bistable device.

5 Claims, 4 Drawing Figures

CONTROL SYSTEM FOR VARIABLE PITCH AXIAL FAN FOR UTILITY BOILER

BACKGROUND OF THE INVENTION

1. Field of the Invention

The invention relates to a control system for a variable pitch axial fan used with the air flow system of a utility boiler.

2. Description of the Prior Art

Fans for furnishing combustion air to utility boilers and for aiding in the removal of combustion gases are typically sized with a margin of safety which will permit continued operation under adverse conditions which may occur and which may require a greater draft than normally required for the boiler. Thus, so-called test block specfications are established which result, in effect, in the selected fans being somewhat oversized in capacity, such as 15 to 20% for example, with respect to normally expected operating conditions. Also, during swing load operating periods the boiler may be operating well below its rated capacity.

Thus, in making a selection between an inlet vane controlled centrifugal fan and a variable pitch axial flow fan, one factor which is given consideration is the static efficiency of the fans under various operating conditions below rated capacity as well as at rated capacity. While variable pitch axial flow fans may have a lower static efficiency than the centrifugal fan at test block conditions, at a condition of normal 100% boiler load the efficiency advantage is reversed. Further, as the boiler load drops further and further below 100%, the efficiency advantage of the axial fan increases more and more. For this reason, as well as others, the variable pitch axial flow fan is considered to be more desirable than the centrifual fan in some application.

However, axial flow fans are more subject to the stall phenomenon resulting from a condition in which the blade attack angle is too steep relative to the mass air flow (and hence velocity). Under the stall condition a static pressure rise across the fan is excessive for the flow rate and potential damage from the vibrations associated with a continued stall condition can occur. Therefore it is apparent that prevention of a stall condition of variable pitch axial fans in the utility boiler draft applications is desirable.

This well known problem of stall in connection with axial flow fans has been dealt with in several ways. One known way of preventing stall in connection with an axial flow turbo compressor having adjustable inlet guide vanes and adjustable stator vanes and used in blast furnace service is to use a blow-off valve to atmosphere between the compressor and the blast furnace to reduce the discharge pressure when it is excessive relative to the flow. However, it is considered undesirable in a utility boiler application to attempt to blow off to atmosphere since on the forced draft side of the boiler furnace this will create other repercussions, as in fuel-air ratios for example, and on the induced draft side of a boiler furnace it would be combustion gases being blown off before their treatment in the passage to the stack.

In an arrangement for an air conditioning and ventilating system for a building as disclosed in U.S. Pat. No. Re. 28,946, provision is made for sensing flow rate and static duct pressure in the duct downstream from a fan, which may be a variable pitch axial fan. The arrangement is intended to maintain a flow rate that is correlated with the static pressure to maintain efficient operation without a surging condition. In the system, the temperature changes in the spaces being served control inlet dampers to the served spaces. Accordingly, the system resistance changes in accordance with temperature demands. As the system resistance is increased due to dampers closing, the flow will be reduced of course while the discharge static pressure increases. This results in the pitch of the fan blades being changed to give a discharge static pressure that is less than at the first reduced flow, which of course results in a further reduced flow. If that is satisfactory for supplying the conditioning, then the system will continue at that same condition. However, if that further reduced air flow is inadequate for conditioning purposes, then the temperature change requirements result in a reduced system resistance and the static pressure will drop and the flow will increase. Thus, with that control arrangement the temperature changes control the system resistance to which the flow responds automatically and in a direction to satisfy the temperature control needs. In the system the duct pressure is continually being used for readjusting the position of louvers or the pitch of the axial fan blades.

In the system according to the present invention, the blade pitch changes will follow the demand of air for the given boiler load and the static pressure rise changes across the fan with the different air flow changes is of no consequence and does not influence the control unless and until a stall condition is approached. Then and only then will the relation of static pressure rise across the fan to air flow volume become a factor in the control and the normal boiler load control of the blade pitch be overridden and blocked by the stall prevention control.

SUMMARY OF THE INVENTION

In accordance with the invention, the variable pitch axial fan connected to the combustion chamber of a utility boiler furnace is controlled with a system including means for varying the pitch of the blades, means for sensing both the pressure rise across the fan and the flow rate in the system and generating signals in accordance therewith, means for integrating the signals to produce a corresponding output signal, means for feeding blade pitch increase and decrease signals to the blade pitch varying means in normal operation to vary the flow rate, irrespective of changes in static pressure rise, in accordance with the boiler load changes, and means for giving an alarm in response to the integrated output signals indicating pressure rises exceeding given levels for corresponding flow rates to warn of conditions within a given degree of stall condition, and for blocking the increase signal and substituting a decrease signal in response to the output signals indicating a predetermined closer approach to a stall condition to thereby reduce the pitch of the blades to a position in which the pressure rise and flow rate are reduced to a safe level with respect to the stall condition.

DRAWING DESCRIPTION

DESCRIPTION OF THE PREFERRED EMBODIMENT

Figure 1:
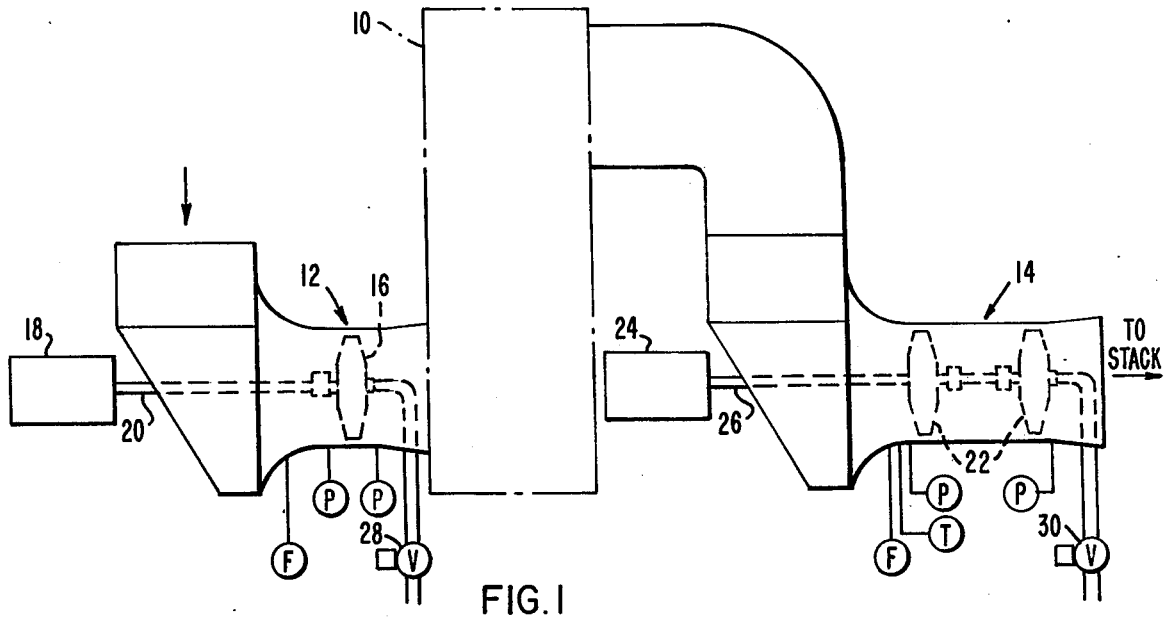
FIG. 1 is a simplified schematic of the air flow system for a utility boiler.

The simplified system shown in FIG. 1 includes the utility boiler furnace 10 with a single stage forced draft axial fan generally designated 12 furnishing combustion air to the furnace, and a two-stage induced draft axial fan 14 for passing the products of combustion from the furnace through dust collectors to the stack. The fan wheel 16 of the forced draft fan is driven by motor 18 through shaft 20 while the two wheels 22 of the induced draft fan are driven by motor 24 through shaft 26. The blade pitch of the fan wheels is controlled in accordance with operating conditions of the system and in particular in accordance with the boiler load to provide the proper fuel-air ratio. Control of the blade pitch is by a hydraulic system with the flow of the hydraulic fluid being controlled by the solenoid valve 28 for the forced draft fan, and valve 30 for the induced draft fan.

The sensing devices for indicating the operating conditions of the air flow system are schematically indicated in FIG. 1, those elements carrying the legend F sensing air flow volume, those with the legend P sensing static pressure and that with the legend T sensing the air flow temperature. Only the induced draft fan is provided with the temperature sensing means since the range in temperature of the air passing through that fan will be significantly greater than that passing through the forced draft fan.

Figure 2:
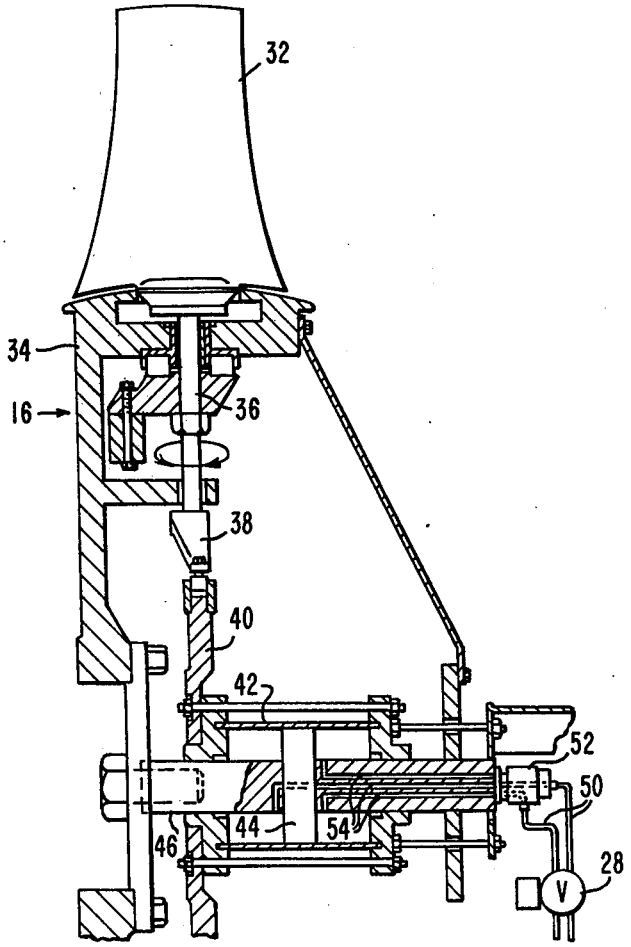
FIG. 2 is a fragmentary view partly in section and partly schematic illustrating the arrangement for controlling the pitch of a single stage forced draft fan.

Referring to FIG. 2, a typical system for varying and controlling the pitch of the blades of the forced draft fan wheel 16 is illustrated. A series of blades 32 around the circumference of the hub 34 are rotatably secured to the hub through rotatable blade shafts 36 which have lever arms 38 secured to their radially inner ends. One end of the lever arm is captured at the periphery of an operating disc 40 so that as the operating disc 40 is displaced to either the left or the right as seen in FIG. 2, the lever arm 38 will effect rotation in one direction or another of the blade shaft and hence the blade. A hydraulic actuator mechanism is provided to effect the displacement of the operating disc. The operating disc 40 is secured to the movable hydraulic cylinder 42 provided with an internal piston 44 which is fixed on the shaft 46. In accordance with operation of a multiposition solenoid valve 28, hydraulic fluid is passed through one of the stationary hydraulic lines 50 and withdrawn from the other of the lines which are connected through a rotating union 52 with internal, axially extending passages 54 in the shaft 46. Thus, fluid is forced into the space on one side of the piston 44 and withdrawn from the space on the other side of the piston 44 to effect the movement of the cylinder 42 in one direction or the other. As the cylinder 42 moves in one direction or the other the operating disc 40 moves accordingly and this effects the rotation of the blades through pivoting of the lever arm and blade shafts. While not illustrated since forming no part of this invention, it will be appreciated the hydraulic system includes check valves, pumps, reservoir and other elements conventional in a hydraulic actuating system so that the blades may be held at one pitch, or moved in either direction. The hydraulic system for varying the pitch of the two fan wheels of the induced draft fan 14 is similar in principle.

Figure 3:
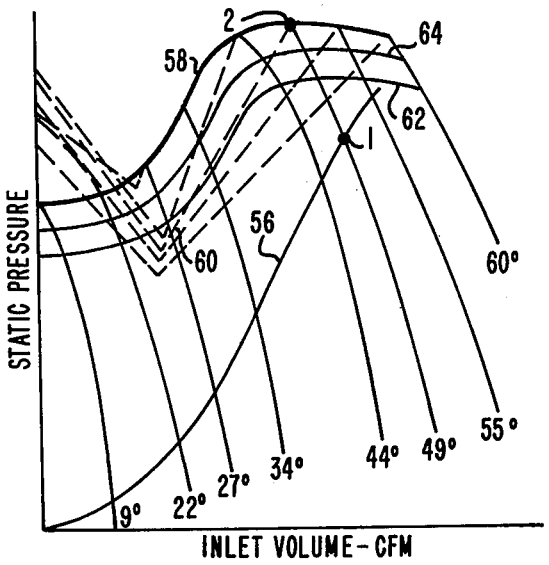
FIG. 3 is a graph illustrating the stall characteristics of a typical pitch axial fan at various blade pitch settings, and with a typical system characteristic curve also shown.

The FIG. 3 graph illustrates values of static pressure rise across an axial fan corresponding to flow with a typical system resistance curve 56, and the blade pitch at various settings. The stall line 58 indicates for various pitch settings the static pressures corresponding to flow values which will result in stall. As an example, with a pitch setting at 49° and the system resistance being normal, the static pressure rise and flow will correspond to that indicated at point 1. Now if there is some untoward occurrence in the system which results in a blockage of air flow, the system resistance changes in an increasing direction and its curve 56 will pivot upwardly and to the left as seen in FIG. 3. If the change is sufficient, and the pitch setting remains at 49°, the point 2 will be reached and the fan will go into a stall condition. If that stall condition is reached, then even if the system resistance is reduced, the fan will continue to operate in a stall condition, following along the dash line 60 or along one of the similarly sloped dash lines if the pitch setting were other than 49°.

Since the complete shutdown of a boiler through a problem with the air system is to be avoided if at all possible, in accordance with the invention a control system to prevent a stall shutdown is provided. This system contemplates that a stall alarm will occur if the relation of static pressure to flow for a given pitch setting reaches the alarm line 62, and that if remedial action is not taken and the fan more closely approaches stall by reaching line 64, an automatically actuated program takes over to reduce the pitch setting to take the fan farther from the stall condition.

Figure 4:
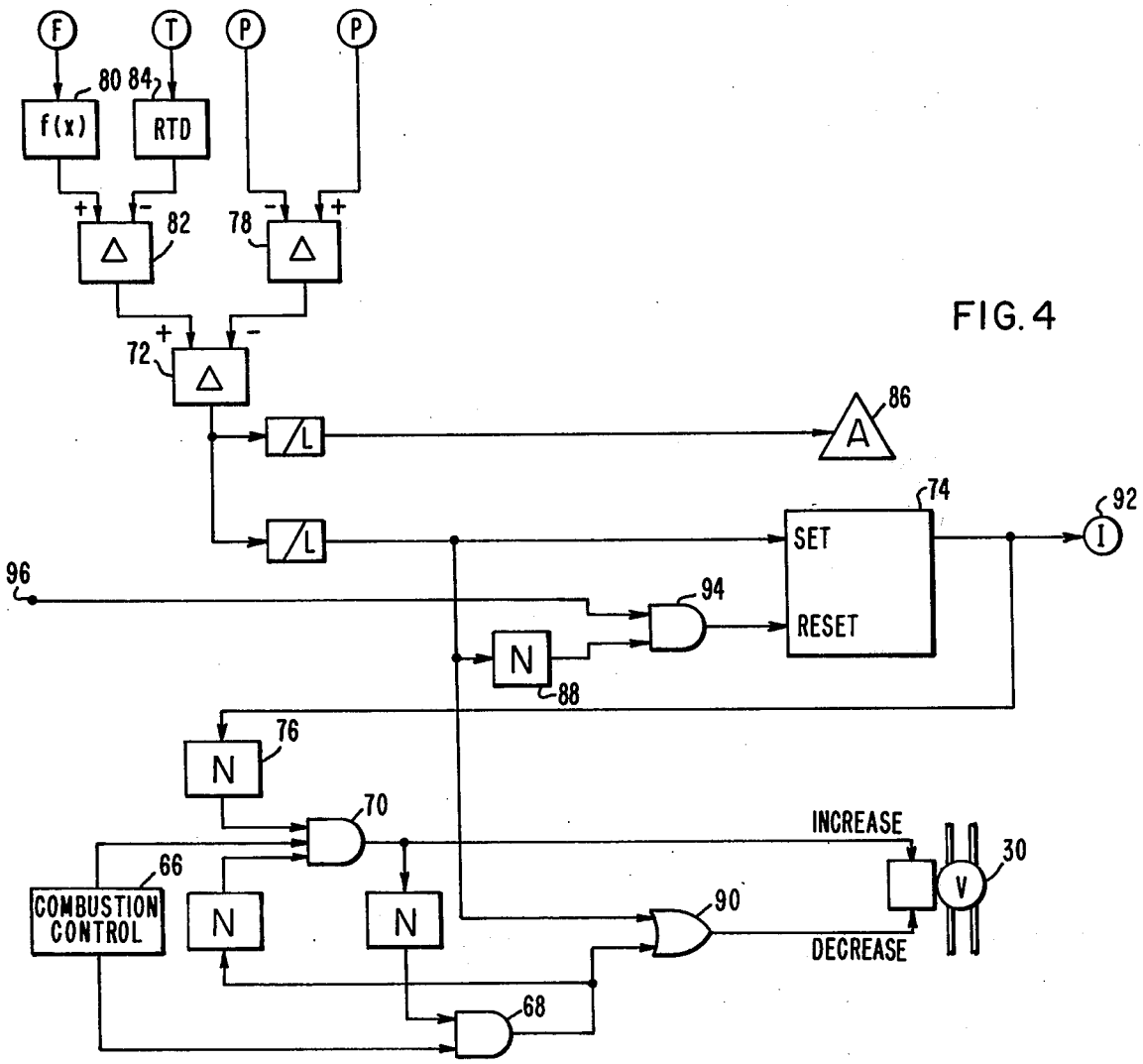
FIG. 4 is a circuit diagram, in block form in part, of the control system arrangement for controlling the induced draft plan part of the arrangement of FIG. 1.

The fan control system for controlling the induced fan 14 is functionally illustrated in FIG. 4 and is the same as that for the forced draft fan 12, except that the temperature sensing and input therefrom may be omitted if desired from the forced draft fan control system.

For normal operation, the control over blade pitch through the solenoid valve 30 is inputted from the combustion control 66 in accordance with boiler load demands to decrease pitch AND gate 68 and the increase pitch AND gate 70. When the fan is operating in an assumed normal operation in which stall is not a problem, there is no signal generated from the stall computer 72 which will interfere with the normal operation increase and decrease signals from the combustion control. In normal operation, the lack of a signal from the stall computer to the set-reset flip-flop 74, whose output is coupled through inverter 76 to an input to the increase AND gate 70, will permit either an increase or decrease signal to the solenoid valve from the combustion control.

Now let it be assumed that an abnormal blockage to air flow occurs and that the static pressure rise across the fan sensed and outputted from the pressure difference computer 78 to the stall computer 72 has risen to a level above the alarm line 62 (FIG. 3), but below the stall shutdown line 64, for the volume of air flow signal outputted from the flow computer 80 and as modified by the temperature curve shifter 82 receiving a temperature indicating signal from the temperature amplifier 84. This will result in the stall computer putting out a signal of a level which actuates the alarm indicator 86 at a control station and thereby warns that there is a problem in the air system and corrective action should be taken, such as reducing the blade pitch through manual control and also the boiler fuel rate to correspond, so that boiler operation continues at a reduced load while the source of the problem is sought.

However, assume that for some reason the operator fails to take the corrective action as indicated by the alarm, and the static pressure rise continues accompanied by a reduction in flow to a point on the stall shutdown line 64. Then, the stall computer puts out a different level signal to the set input of the bistable flip-flop 74, to the inverter 88 and to one input of the OR gate 90 in the decrease line to the solenoid valve 30. The output signal from the flip-flop 74 through inverter 76 results in blocking the increase AND gate 70 from passing an increase signal to the solenoid valve, while the OR gate 90 passes the decrease signal to the solenoid valve. The flip-flop output signal is also transmitted to an indicating device 92 to inform the operator that the automatic stall prevention system has control of the system. As such, even after the blade pitch has been decreased to a degree that the signal from the stall computer 72 is removed, neither the automatic combustion control 66 nor a manual operation can result in an increase signal to the solenoid valve because of the flip-flop 74 being in a set condition. This flip-flop functions as an anti-hunt bistable memory device which will maintain the blocking signal to the increase AND gate 70 until the operator resets the flip-flop with a signal to the AND gate 94 to reset the flip-flop. Since the flip-flop does not prevent a decrease signal, the boiler controls can continue to protect the boiler, i.e., run back the load further via the forced draft fan, or preventing a furnace impolsion by running back the induced draft fan.

As may be seen in FIG. 3, basically as the flow volume increases, so does the allowable static pressure rise across the fan. The flow computer 80 converts the percent of flow to the non-linear curve required and the output from this computer represents the maximum allowable inlet to outlet pressure set point, as modified by the temperature curve shifter 82, which will in effect lower the curves as the temperature rises.

The stall computer subtracts pressure out from pressure in as computed by the pressure difference computer and compares it against the maximum allowable outlet to inlet pressure set point. A pressure rise greater than the maximum allowable pressure rise as a function of flow results in a decreasing signal from the stall computer. The stall alarm warns of an impending stall, with the second level stall fan shutdown operating the anti-hunt memory device and actuating previously described corrective action taken during the stall approach.

We claim:

1. A control system for an axial flow fan having variable pitch blades in an air flow system connected to the combustion chamber of a utility boiler, comprising:

means for varying the pitch of said blades;

means for detecting the pressure rise across said fan and generating a signal in accordance with said pressure rise;

means for detecting the air flow rate in said system and generating a signal in accordance therewith;

means for integrating said pressure rise signal and said air flow rate signal to produce an output signal corresponding to the existing flow rate and pressure rise;

means for feeding blade pitch increase and decrease signals to said blade pitch varying means in normal operation to vary the air flow rate, irrespective of changes in static pressure rise, in accordance with boiler load changes;

means for giving an alarm in response to said output signals from said integrating means indicating pressure rises exceeding given levels for corresponding flow rates to warn of conditions within a given degree of stall conditions, and for blocking said increase signal and substituting a decrease signal in response to said output signals indicating a predetermined closer approach to a stall condition to reduce the pitch of said blades to a position in which the pressure rise and flow rate are reduced to a safe level with respect to a stall condition.

2. A control system according to claim 1 including:

means responsive to said predetermined closer approach to stall to indicate to the user that normal operation control is disabled.

3. A control system according to claim 1 including:

bistable means responsive to said predetermined closer approach to stall to prevent the user from feeding a blade pitch increase signal to said pitch varying means until said bistable means is reset to a normal operating position.

4. An air flow system for controlling the draft for a utility boiler, comprising:

an axial flow fan having variable pitch blades;

means for varying the pitch of said blades;

means for normally controlling said blade pitch by increase and decrease air flow signals generated in accordance with boiler load demand and passed to said pitch varying means, irrespective of changes in static pressure rise across said fan resulting from the change in blade pitch and flow;

fan stall alarm and prevention means for overriding said normal control means including means for sensing the static pressure rise across said fan and for sensing the flow volume through said fan, and means for giving an alarm signal in response to a sensed pressure rise exceeding a first given level for the sensed corresponding air flow to warn of the condition within one range of values approaching a stall condition, and for generating a signal to block any increase signal and substituting a decrease signal to said blade pitch varying means in response to a further increase of sensed pressure rise for the sensed corresponding air flow indicating a condition within another range of values more closely approaching stall than said one range of values.

5. An air flow system according to claim 4 including:

set-reset bistable means responsive to said blocking signal to operate to a set condition preventing a blade pitch increase signal until said bistable means is reset, irrespective of a reduction of static pressure below said another range of values; and means indicating the condition of said bistable means.

* * * * *